United States Patent [19]

Spencer, III

[11] Patent Number: 4,768,451

[45] Date of Patent: Sep. 6, 1988

[54] APPARATUS FOR TURNING POCKET-LIKE FABRIC WORK PIECES

[75] Inventor: James T. Spencer, III, Greensboro, N.C.

[73] Assignee: Blue Bell, Inc., Greensboro, N.C.

[21] Appl. No.: 41,870

[22] Filed: Apr. 23, 1987

[51] Int. Cl.[4] ..... D05B 21/00; D05B 27/00

[52] U.S. Cl. ..... 112/121.12; 112/121.15; 112/303; 112/306; 112/262.3; 198/403; 198/464.2; 38/101

[58] Field of Search ..... 112/121.12, 121.11, 112/121.15, 303, 306, 262.3; 223/2, 52.1, 39; 38/101

[56] References Cited

U.S. PATENT DOCUMENTS

| | | | |
|---|---|---|---|
| 3,125,261 | 3/1964 | Arbter | 223/39 |
| 3,789,781 | 2/1974 | Carson et al. | 112/121.12 X |
| 4,133,280 | 1/1979 | Takatori et al. | 112/121.15 X |
| 4,213,547 | 7/1980 | Connor, Jr. | 203/2 |
| 4,425,858 | 1/1984 | Hangett | 112/121.12 |
| 4,427,139 | 1/1984 | Depriest | 223/2 |
| 4,539,924 | 9/1985 | Bell, Jr. et al. | 112/121.15 |
| 4,608,936 | 9/1986 | Ball et al. | 112/121.12 |
| 4,649,838 | 3/1987 | Gazzarrini | 112/121.15 |

*Primary Examiner*—H. Hampton Hunter

*Attorney, Agent, or Firm*—Charles R. Rhodes; Judith E. Garmon

[57] ABSTRACT

Method and apparatus for automatically and sequentially transferring and inverting preformed pocket-like fabric blanks from a first sewing station where a first seam is applied to an outturned marginal edge to a second sewing station where a second parallel seam is applied to the inturned marginal edge. A first pickup mechanism identifies, lifts, and transfers multiple ply fabric work pieces from the surface of a work table onto a spreading jaw mechanism by clamping on the upper ply or plies of the work piece with a pair of gripping fingers. The first mechanism is inserted between the plies and operable to grip the upper ply of the work piece, even where the confronting, unseamed, marginal edges of the work piece are not aligned. A second spreading jaw mechanism includes a pair of vertically spreadable jaws onto which the fabric blank is placed. A third inverting mechanism slides between the spread jaws to invert the work piece onto a split mandrel. The mandrel is formed of a pair of laterally expandable plates which stretch the fabric blank laterally to prepare it for the second seaming operation. The blank is then passed through a wrinkle pressing assembly and onto a work table in preparation for the second seaming operation.

12 Claims, 14 Drawing Sheets

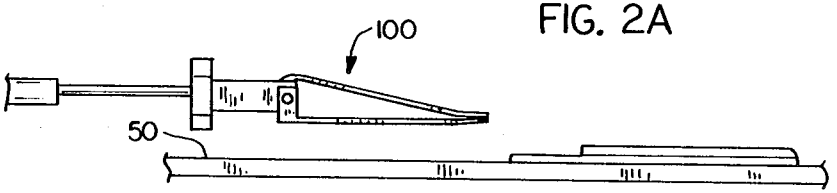
FIG. 2A
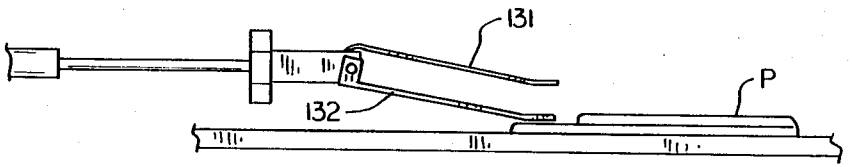
FIG. 2B
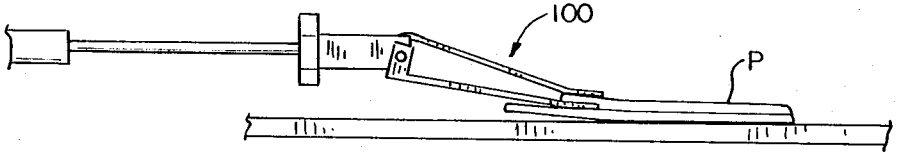
FIG. 2C
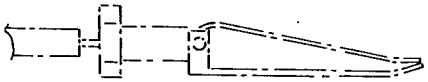

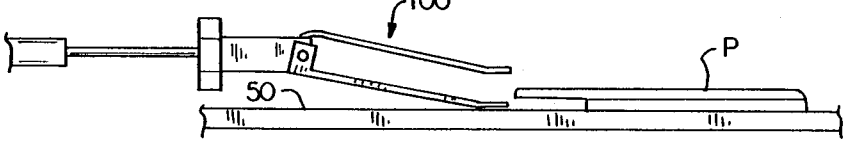
FIG. 2D
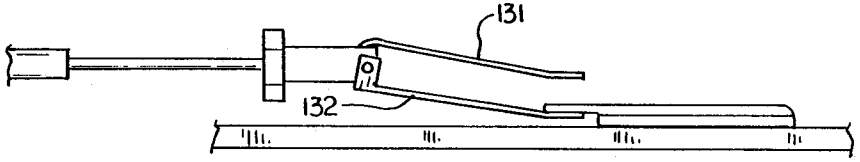
FIG. 2E
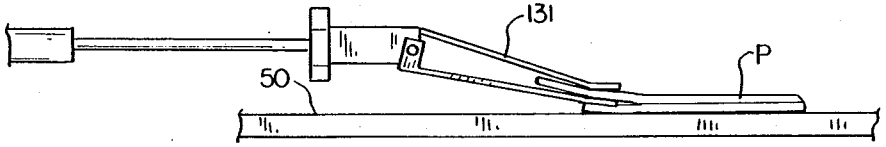
FIG. 2F
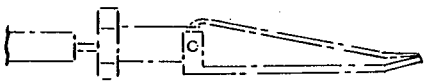

APPARATUS FOR TURNING POCKET-LIKE FABRIC WORK PIECES

BACKGROUND AND SUMMARY OF THE PRESENT INVENTION

This invention relates to mechanisms used in conjunction with sewing operations, and more specifically to a fully mechanized method and apparatus for automatically transferring and inverting pocket-like fabric work pieces from a first seaming station to a second seaming station with an intermediate inverting operation.

In the formation of certain garment subcomponents, illustrative pockets, collars, cuffs, epaulets, cap bills, and the like (hereinafter referred to as pocket-like work pieces), it is known to stitch together a plurality of superposed plies or layers of fabric together (sometimes with an intermediate stiffener layer such as buckram in the case of collars, cap bills, and cuffs). After the layers are assembled by means of a first peripheral seam extending around some, but not all, sides of the work piece, the work piece is inverted. After such inversion the first seam initially connecting the layers then defines the outer margin or edge of the work piece. The inverted layers are then subjected to a pressing operation following which the pressed work piece is subjected to a second seam parallel to the first seam through the doubled-over plies adjacent the margin or edge of the work piece. During and subsequent to the inversion operation it is highly desirable that the initial seam lie exactly on the marginal edge of the work piece in order to result in an eventual garment of high quality. The above-described procedure is commonly referred to as a "stitch-turn-stitch" operation.

Previously the above-described inverting operation has been accomplished substantially by hand. In the forming of pockets as taught by applicant's earlier U.S. Pat. No. 3,789,781 to Carson et al, once the first seam was applied to the superposed fabric layers, the operator manually placed the pocket on an upstanding mandrel 150, whereupon the operator manually turns or reverses the pocket thereupon. The manual inversion of the pocket work piece is very time consuming because in addition to totally consuming the time of an operator, it is very difficult to align the first formed seam exactly along the work piece edge. Other examples of devices in the prior art which are intended to facilitate the forming of double ply pocket-like work pieces include U.S. Pat. Nos. 3,125,261 to Arbter; 4,213,547 to Connor, Jr.; and 4,427,139 to Depriest.

Although the invention will be described in conjunction with the production of garment pockets, the basic concepts of the invention are also susceptible to other applications of the "stitch-turn-stitch" operation, such as collars, cuffs, and the like. Briefly stated the present invention is directed to a method and apparatus for automatically handling the pocket-like work piece from the time a seaming apparatus finishes the first stitching operation until the inverted work piece is ready to have the second seam applied. During the interim period, the work piece is inverted and pressed. In addition to the obvious labor savings, quality is maintained as the machine is so designed as to ensure that the first seam, when inverted, lies exactly along the marginal edge.

Generally, the present invention is directed to a method and apparatus for forming pocket-like, multiply work pieces which are double seamed along portions of at least some, but not all, sides. The apparatus includes spaced sewing instrumentalities, one of the sewing instrumentalities applying a first seam to the work piece and the second of the sewing instrumentalities applying a second seam to the work piece after it is inverted. A pickup mechanism grasps the uppermost ply of the work piece adjacent an unsewn side and transfers the work piece onto a spreading mechanism which is inserted between the separated plies of the work piece as it is removed by the pickup mechanism. The jaws of the spreading mechanism are then spread vertically to space the plies of the pocket-like work piece, whereupon the jaw mechanism is moved from a loading position to a discharge position in alignment with an inverting mechanism. The inverting mechanism includes a split plate mandrel insertable between the jaws of the spreading jaw mechanism. The mandrel engages a sewn side of the work piece as it enters, inverting and transferring the work piece from the jaw mechanism onto the mandrel. The expandable mandrel is then spread laterally to form the correct pocket shape, set the first seam along the marginal edge, and retain the pocket on the mandrel assembly as it is retracted from the spreading jaw mechanism. The work piece, while still mounted on the expanded mandrel, is then passed through opposed pairs of counter-rotating rotary brushes which smooth and straighten the pocket on the mandrel. The inverted pocket or work piece is then presented to the second sewing instrumentality for applying the second seam.

The pickup mechanism itself is adapted for use with pockets of a type in which the unseamed side is comprised of non-aligned edges. First, the pickup mechanism includes a sensor which identifies whether the upper ply extends laterally beyond the lower ply or vice versa, and transmits an electrical signal representative thereof. A pair of vertically spaced upper and lower clamping fingers are then moved from a retracted first position to an extended second position at the loading station. The clamping fingers are pivotally attached at one end for moving the free ends thereof between a clamping position, an open position, and a first or second insertion position. The lower clamping finger is then controlled by the aforesaid signal generated by the sensor as it is moved inwardly. Thus the lower clamping finger is caused to move along either a first insertion path which corresponds to a receding upper ply edge, or a second insertion path which corresponds to a protruding upper ply edge.

The spreading device includes a pair of vertically spaced, horizontally extending jaws which are moved from a first closed position to a second open position. Once the pocket is loaded onto the spreading device it is rotated from a loading position to a discharge or inverting position. The inverting device includes an expandable mandrel positioned adjacent the spreading device when in the discharge position. The expandable mandrel is then inserted between the jaws of the spreading mechanism. The expandable mandrel includes a pair of substantially horizontally planar, juxtaposed plates, one of the plates at least partially overlying the other. The mandrel assembly is moved forwardly into an extended position between the jaws of the spreading device which engage and invert the work piece, and transfers it onto the mandrel assembly right side out. Simultaneously the mandrel control means also expands the plates laterally from a collapsed position into a laterally expanded position to spread and stretch the work piece.

The aforesaid mandrel assembly is adapted to be moved between a first retracted position and either of two extended positions. The length of the stroke of the forward thrust of the expandable mandrel is determined by a pair of pivotally actuated stop members which are electrically controlled to move between an upward position which determines the shorter length stroke and a downward position which determines the longer length stroke.

As the plies of the work piece are spaced apart on the spreading device a laterally expandable seam locater lever engages and maintains the first seam exactly on the marginal edge as the work piece is turned right side out. Upon inversion the work piece becomes mounted on the mandrel assembly with the first seam defining the marginal edge thereof ready for application of the second seam. Prior to the removal of the work piece from the mandrel and the second seaming operation, the mandrel with the work piece mounted thereon is passed between one or more opposed pairs of bristle covered rollers which iron and smooth out the wrinkles.

It is therefore an object of the present invention to provide an improved method and apparatus for inverting pocket-like work pieces subsequent to a first and prior to a second seaming operation.

It is another object of the present invention to provide a method and apparatus of the type described which is fully automated.

It is yet a further object of the present invention to provide an improved device for identifying and picking up a double-ply fabric work piece from a support surface, even where the unseamed edges of the work piece are not aligned, and mounting the work piece on a support of the type which is inserted between the plies of the work piece.

Yet another object of the present invention is to provide an apparatus for inverting pocket-like work pieces about a horizontal seam while maintaining the seam contiguous with the edge of the inverted work piece.

Other objects and a fuller understanding of the invention will become apparent upon reading the following detailed description of a preferred embodiment along with the accompanying drawings in which.

Figure 3:
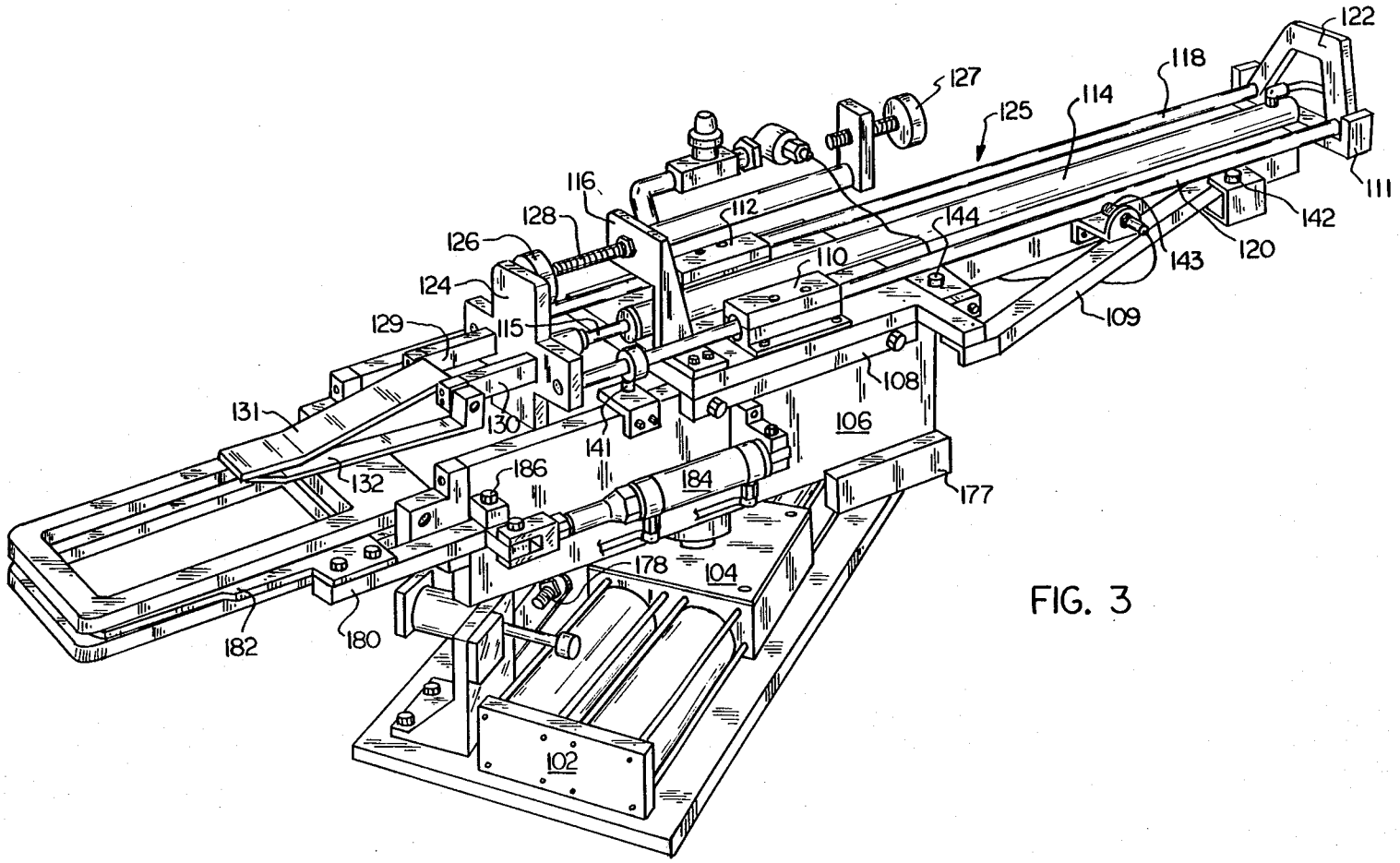
Figure 4:
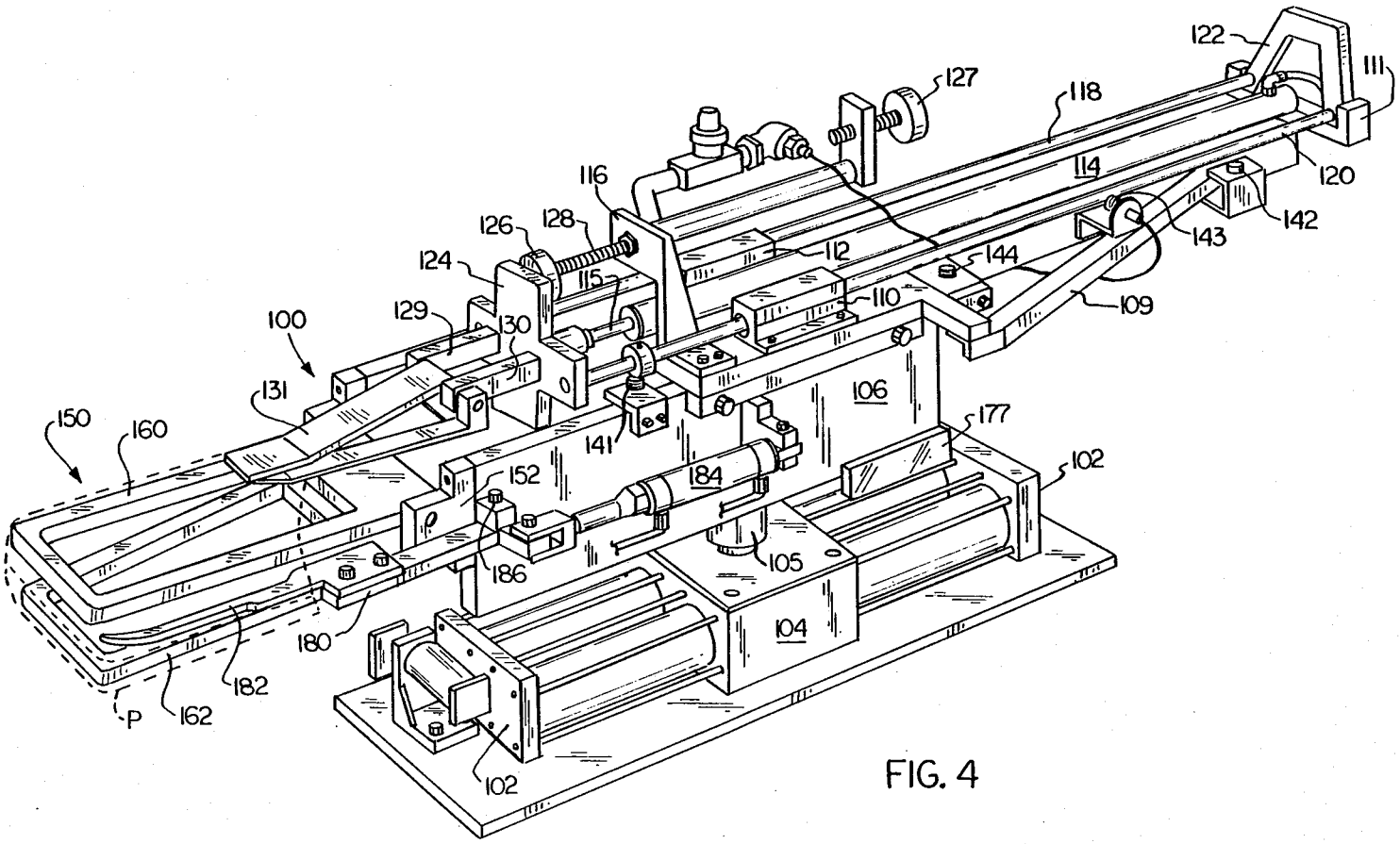
Figure 5:
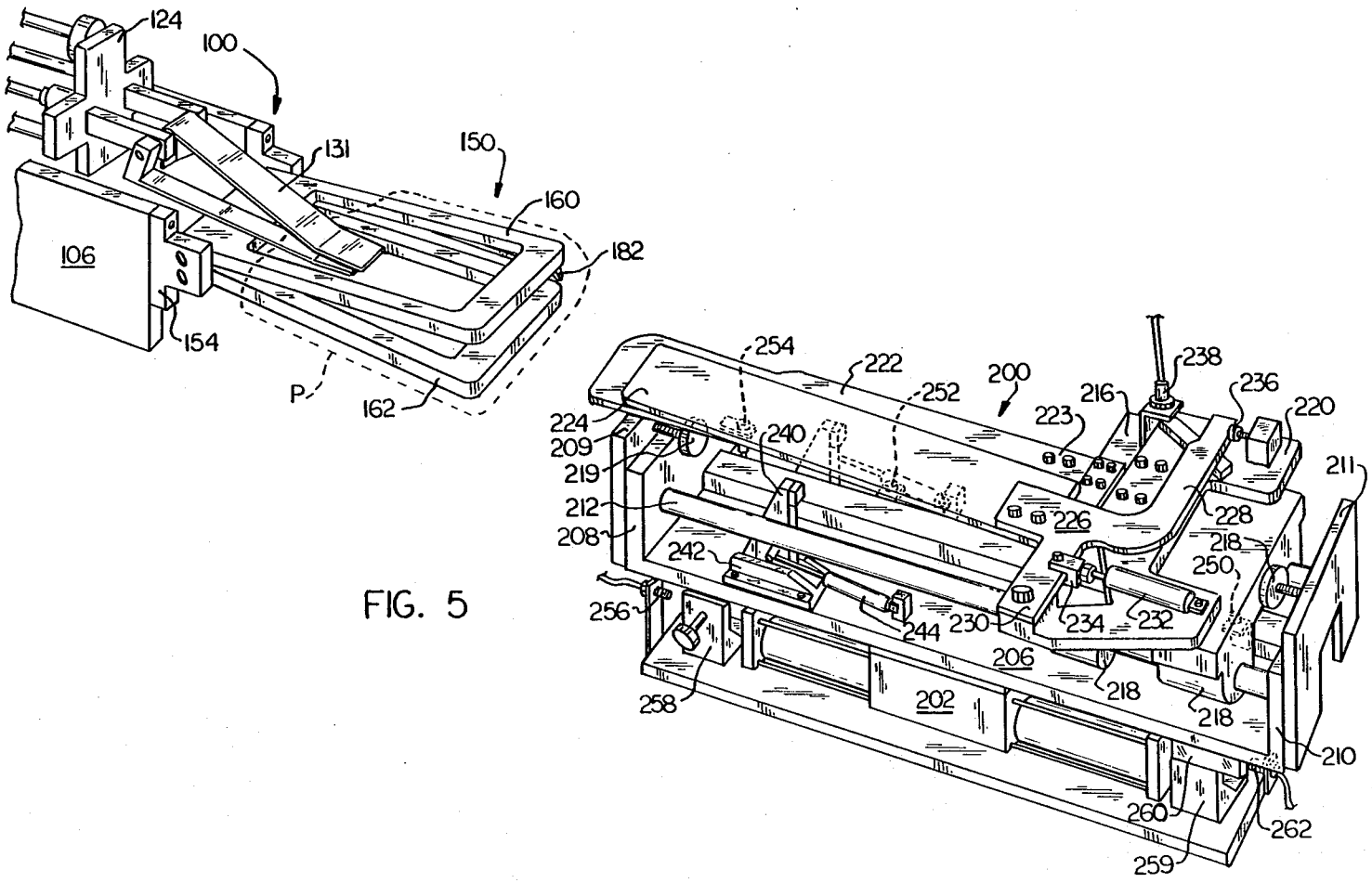
Figure 6:
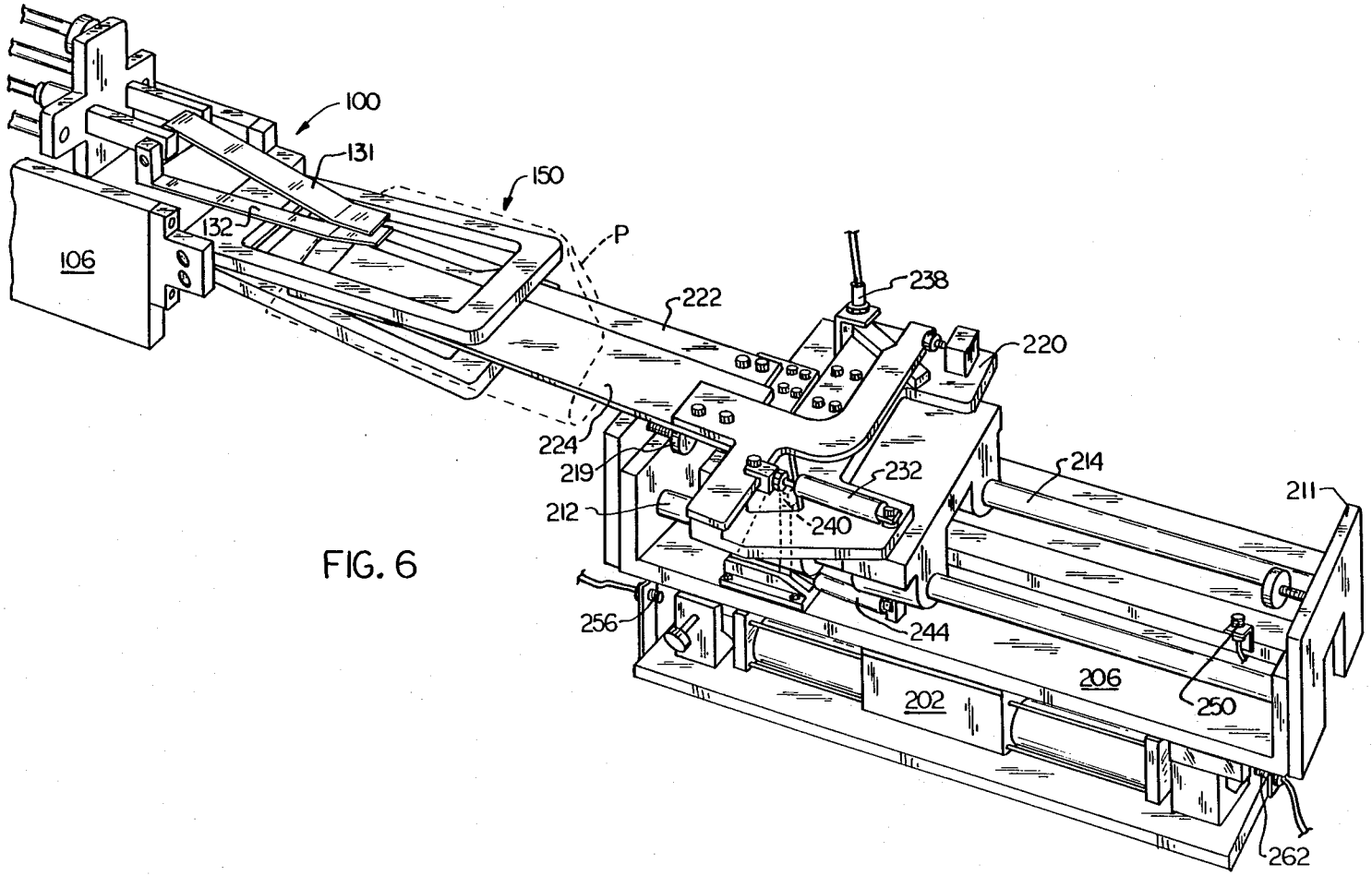
Figure 7:
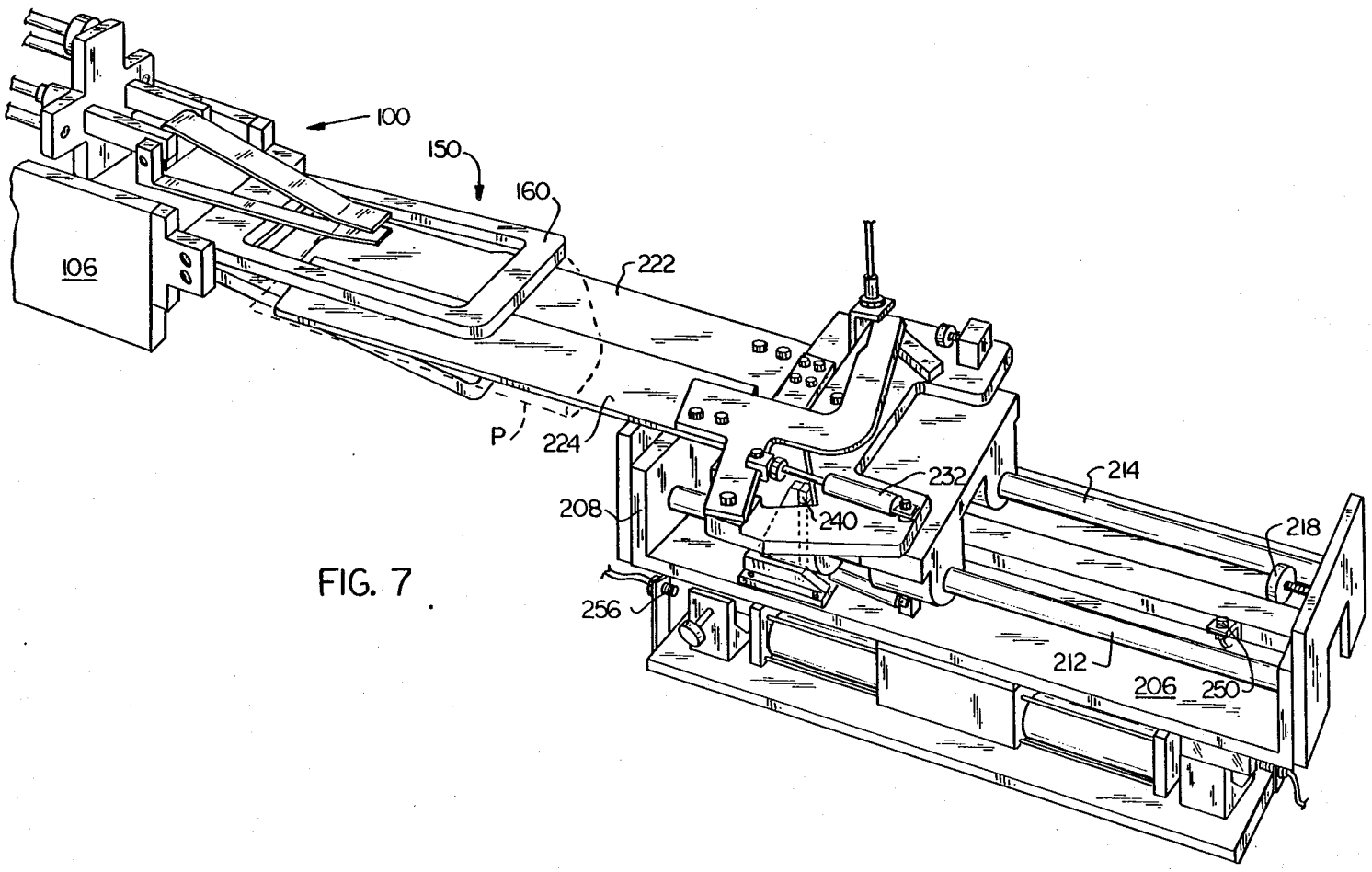
Figure 8:
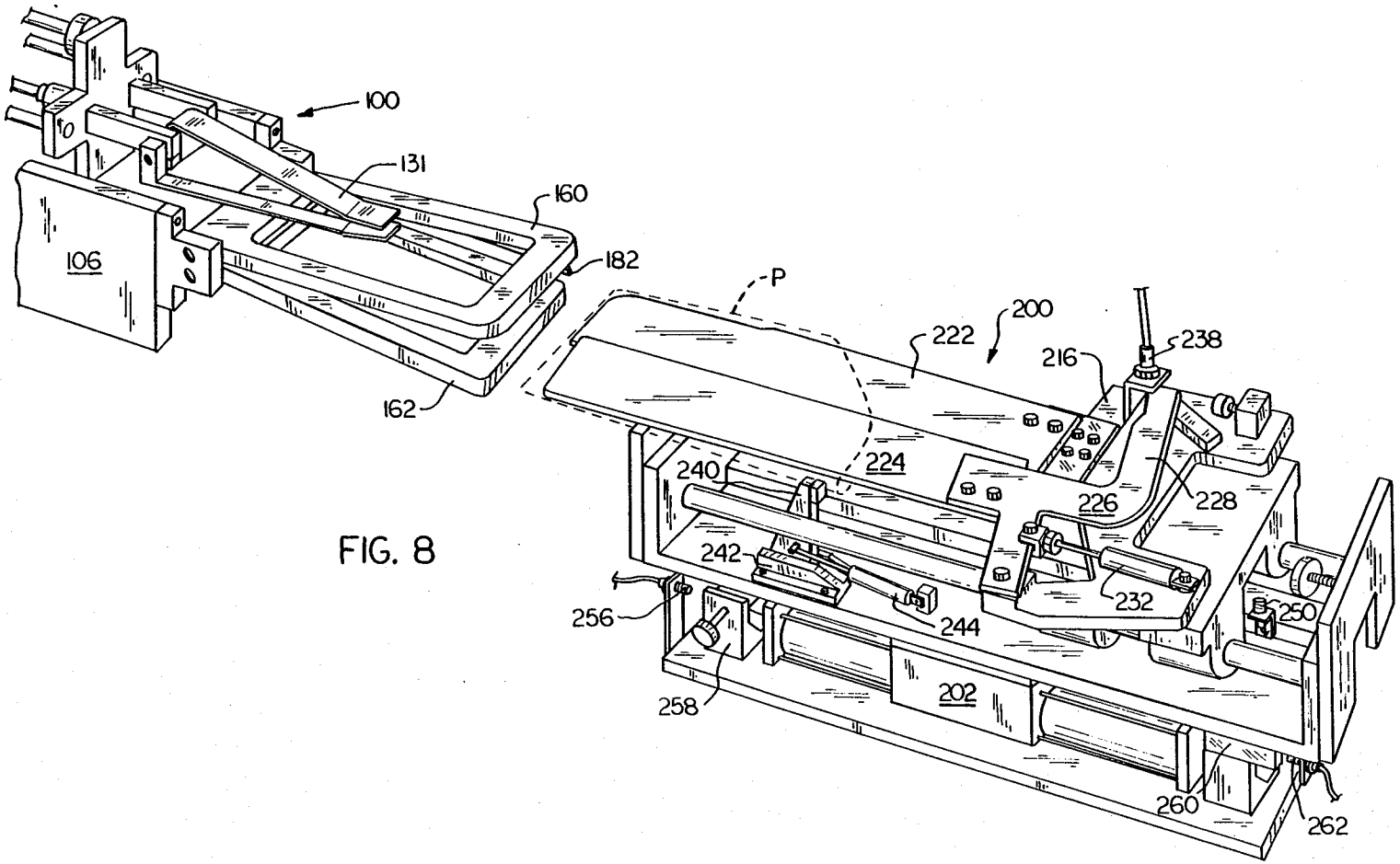
Figure 9:
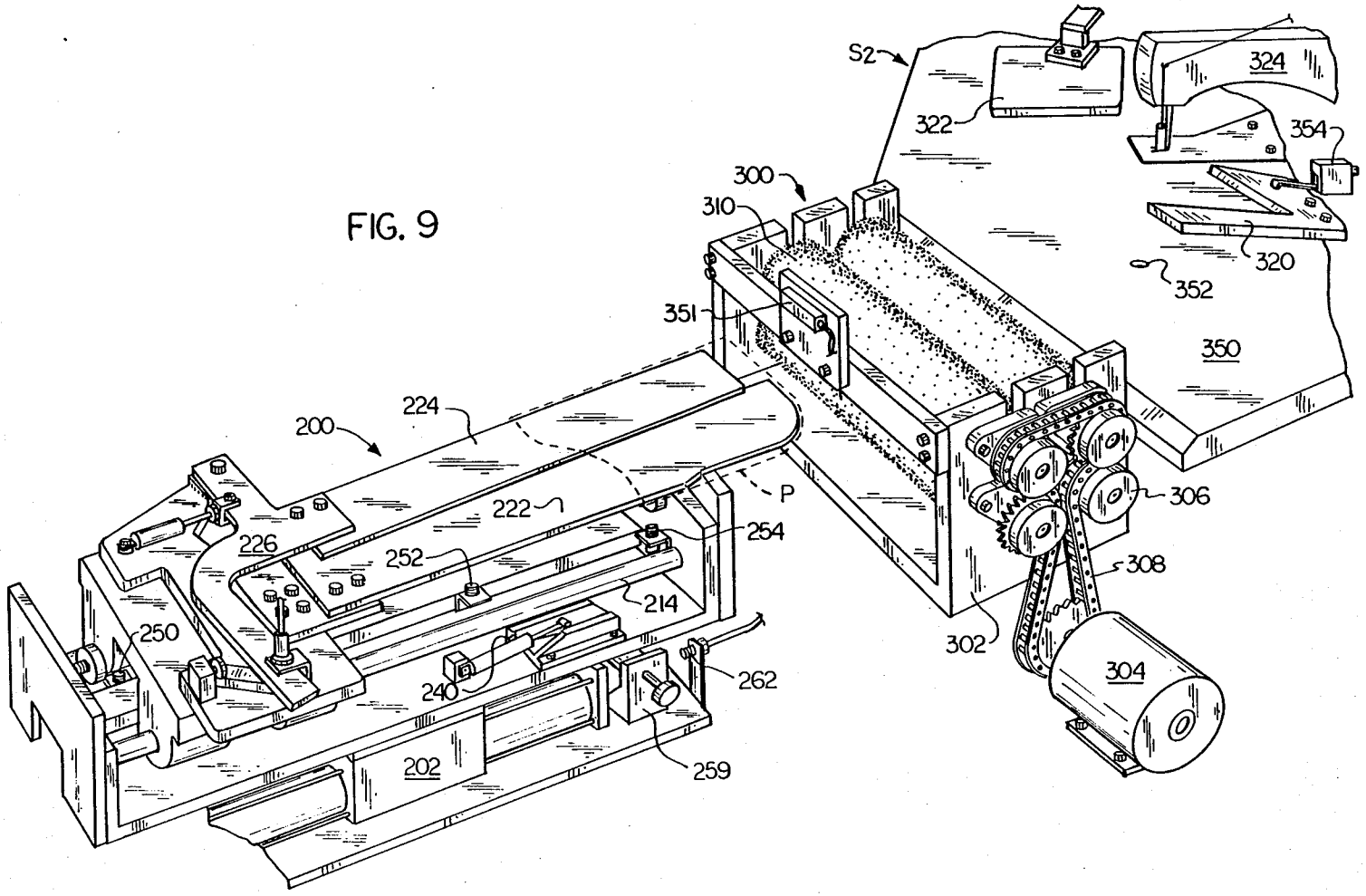
Figure 10:
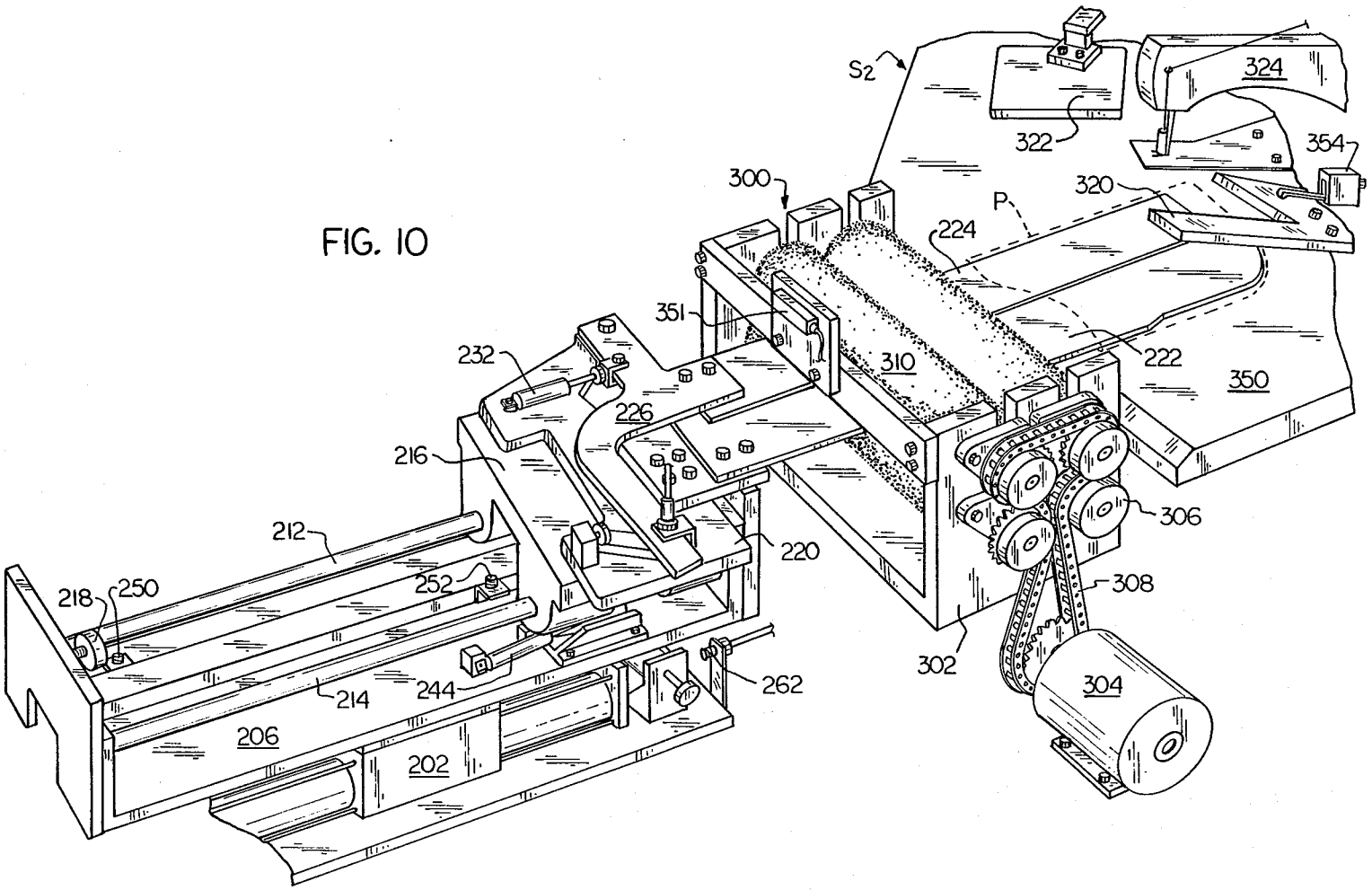

FIGS. *2a–2f* are schematic representations of the pickup fingers operated to transfer different types of work pieces;

FIG. 3 is a perspective view of the pickup and spreader mechanisms rotated to the loading position;

FIG. *3a* is a perspective view, with parts broken away, of the front end of the spreading mechanism;

FIG. 4 is a perspective view similar to FIG. 3 except showing the spreader mechanism rotated to the discharge position;

FIG. *4a* is a perspective view similar to FIG. 4, except showing the reverse side of the spreader mechanism;

FIG. 5 is a perspective view of the inverter mechanism positioned adjacent the spreader mechanism in the discharge position;

FIG. 6 is a perspective view similar to FIG. 5, except showing the mandrel of the inverter assembly extended to an intermediate position between the spreader jaws and the pocket inverted onto the mandrel;

FIG. 7 is a perspective view similar to FIG. 6, except showing the mandrel assembly spread;

FIG. 8 is a perspective view similar to FIG. 7, except showing the inverter assembly retracted;

FIG. 9 is a perspective view similar to FIG. 8, except showing the inverter assembly rotated 180° and positioned adjacent the wrinkle pressing mechanism; and FIG. 10 is a perspective view similar to FIG. 9, except showing the inverter assembly fully extended to position the work piece on a work table adjacent the second sewing instrumentality.

DETAILED DESCRIPTION OF A PREFERRED EMBODIMENT

Figure 1:
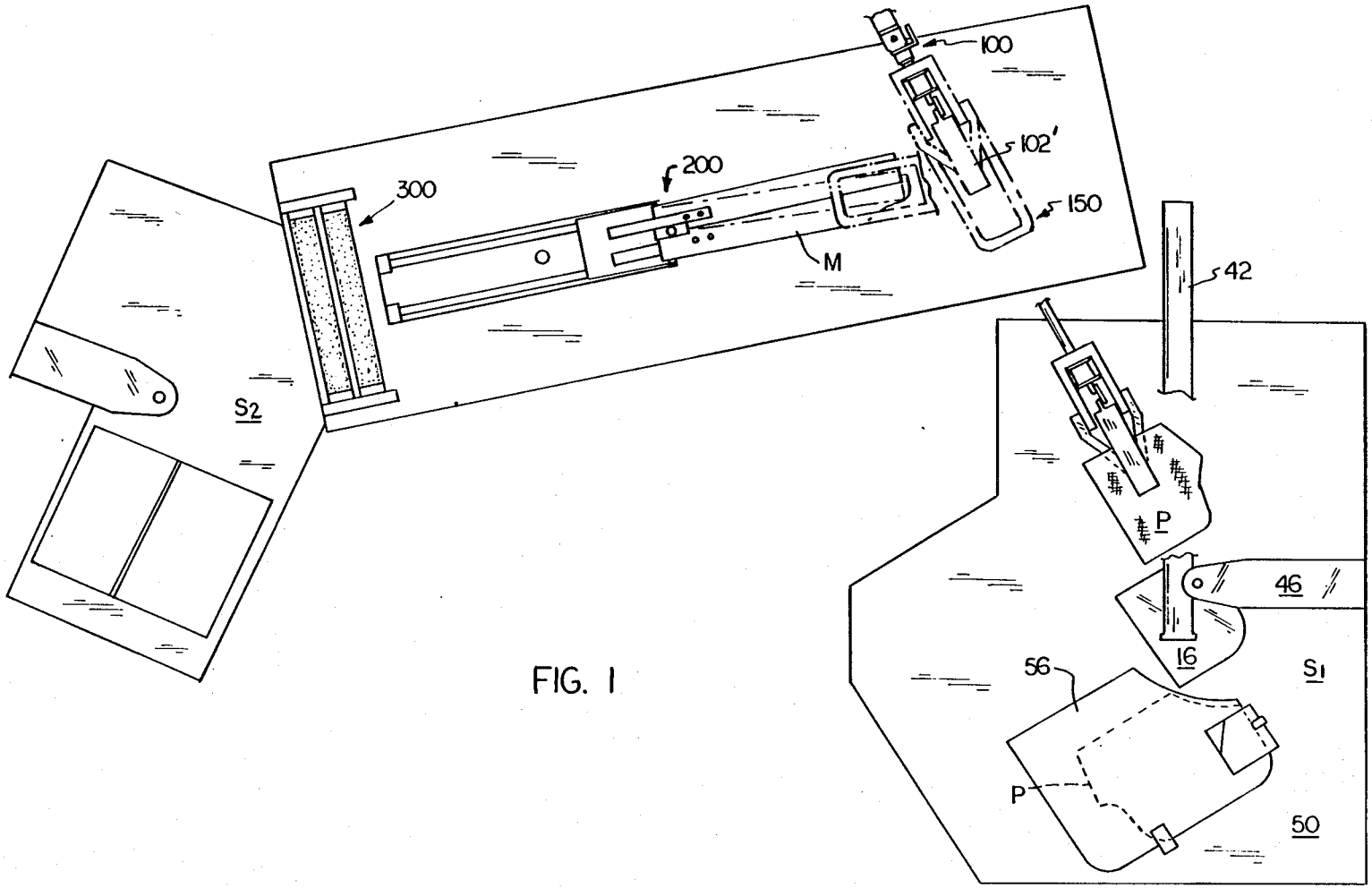
FIG. 1 is a top plan view schematically illustrating the apparatus according to the present invention.

Referring to the drawings, and particularly to FIG. 1, there is illustrated a preferred embodiment of the present invention as presently known. Various refinements to the illustrated embodiment are possible and even contemplated. As depicted, the apparatus of the present invention is directed to a pocket pickup mechanism 100, a spreader mechanism 150, and an inverting mechanism 200 positioned between two sewing instrumentalities S1,S2 (FIG. 1). Multiple-layer pocket-like work pieces are preformed and the marginal edge thereof is partially seamed at the first sewing instrumentality S1. The pickup mechanism 100 removes the initially seamed pocket work piece P from the area of the first sewing instrumentality S1, and places the work piece on the spreader mechanism 150. The inverter mechanism 200 inverts the work piece and places it into position at the second sewing instrumentality S2 for the final seaming thereof. The pickup mechanism 100 lifts and transfers double-ply fabric work pieces from the surface of a work table adjacent the first sewing instrumentality S1 onto a spreading jaw mechanism 150 by clamping the upper ply of the upper work piece with a pair of gripping fingers 102'. The spreading mechanism 150 includes a pair of vertically spreadable jaws onto which the fabric work piece is placed (FIG. 3). The spreading mechanism 150 is then rotated into alignment with an inverting mechanism 200 which includes split mandrel M slidable in a longitudinal path between the spread jaws to engage and invert the work piece P onto the mandrel M. The mandrel M itself includes a pair of laterally spreadable plates (to be hereinafter described) which stretch the fabric work piece laterally and prepare it for the second seaming operation. Once the work piece is securely emplaced on the expandable plates of the inverting mandrel M, the work piece is passed between a series of counter-rotating brushes which smooth the wrinkles and straighten the pocket on the expandable plates. The pocket-like work piece P is then deposited adjacent the second sewing instrumentality S2 and the mandrel M removed therefrom. The pocket-like work piece P is then processed through the second sewing instrumentality where the second seam is applied slightly inwardly of the first seam. During the entire operation, the pocket-like work piece is transferred automatically by the aforesaid mechanisms so that the operator never has to touch the work piece.

Pocket Pickup Mechanism

The first sewing instrumentality S1 is substantially the same as that shown and illustrated in the Carson et al U.S. Pat. No. 3,789,781. In this regard, and generally, there is provided a folder mechanism 56 mounted for displacement relative to the table top 50 and to the sewing machine 46. The clamping and displacing assembly 42 receives folded fabric blanks 32 from the folder mechanism 56 and directs each blank in a preselected path with respect to the sewing instrumentality S1 for applying a first seam thereto.

The clamping and displacing assembly 42 includes a relatively flat plate 16 mounted at the free end thereof. The plate 16 is movable between a first position at the folding mechanism 56 and a second position adjacent the sewing instrumentality 46. The clamping and displacing assembly 42 is operated as described in the Carson et al U.S. Pat. No. 3,789,781 to apply a first seam around a portion of the periphery of fabric blank 32. As the plate 16 is moved from the first to the second position, a pad member or fingers 38 move the previously sewn pocket P in the same direction with the same speed as plate 16 moves the pocket being sewn into the position to be picked up by the pickup mechanism 100.

Figure 2:
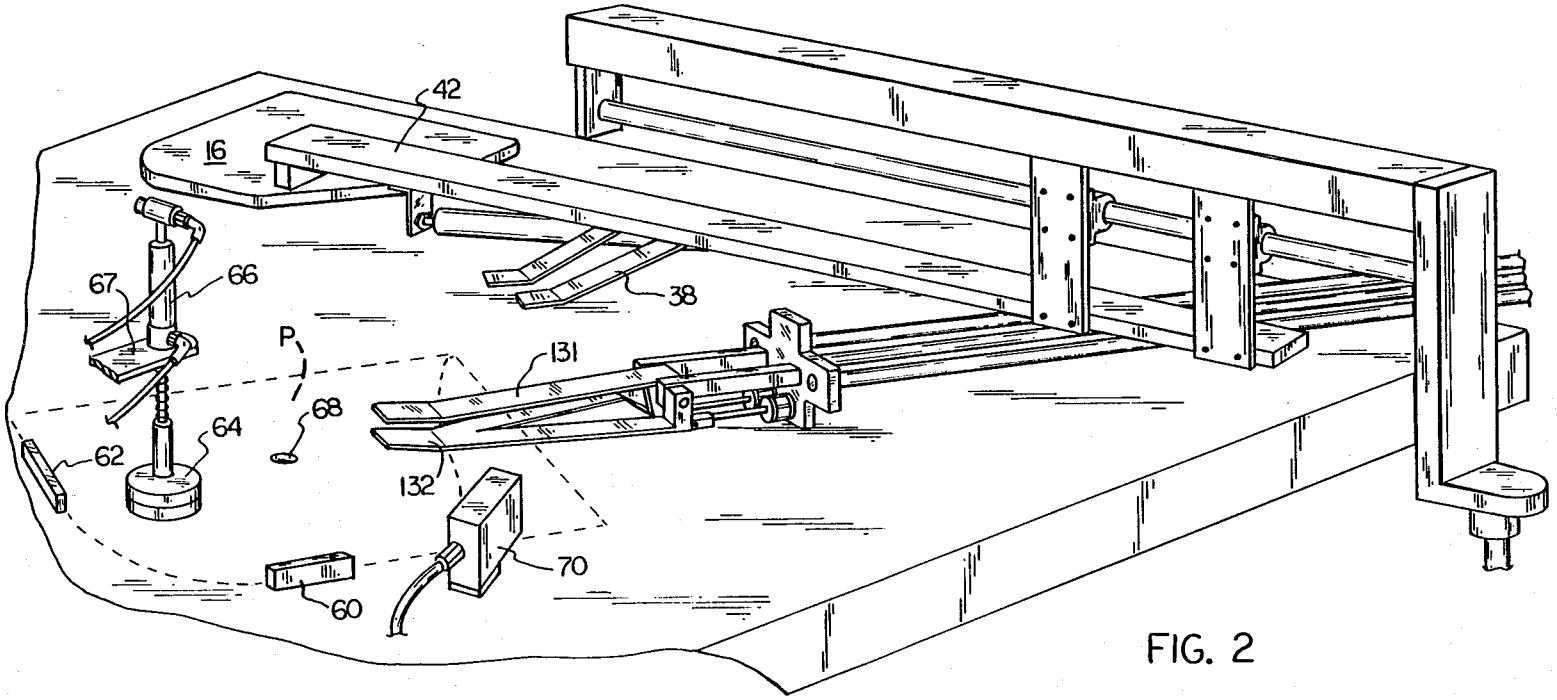
FIG. 2 is a perspective view, with parts broken away, of the work station adjacent the first sewing instrumentality where the fabric work piece is positioned for transfer by the pickup mechanism.

Looking now at FIG. 2, the sewn pocket P is emplaced at a loading position on the surface 50 of the work table which carries the first sewing machine 46. After the fingers 38 have deposited sewn pocket P in the proper position against positioning stops 60, 62, a pocket clamp 64 is activated to hold the pocket P in place during the positioning of the above-described pickup mechanism 100. Pocket clamp 64 is activated by a linear actuator 66 (air cylinder), which actuator 66 and clamp 64 are supported by a bracket member 67. A photocell 68 in the surface of work table 50 indicates the presence of a pocket in the unloading position and activates actuator 66.

An electronic sensor or detector 70 overlies the pocket adjacent the open or unsewn edges thereof. The purpose of detector 70 is to determine whether or not the free edge of the upper ply recedes or overlies the corresponding edge of the lower ply. Responsive to the signal from sensor 70 the pickup mechanism 100 is operated in one of two different modes. In many types of jeans, a blue denim fabric swatch is sewn on the inner surface of the lower ply behind the receding upper ply to provide a cover for white pocket work piece in the finished jean. In such cases the detector 70 may be a color detector such as the Warner Visolux (Model MCS-638). Where a denim fabric swatch has been sewed over the surface of the lower ply (the remainder of the pocket being white) if the color detector 70 detects a colored surface, then the edge of the upper ply is receding from the corresponding edge of the lower ply (first mode or condition). On the other hand, if the color marked detector denotes a white color, then obviously the overlying ply is on top and the receding ply is on the bottom. This is the second condition.

Where the upper ply recedes, the pickup fingers must follow a path such that the lower finger is held up in an elevated position until it passes the edge of the lower ply. The lower finger then drops to its lowermost position adjacent the surface of the lower ply and slides in between the two plies as it proceeds to its extended position. The upper and lower fingers then clamp together and the pocket part is removed as the mechanism retracts. Conversely where the detector 70 denotes that the overlying ply is the upper ply (second condition), then the lower pickup finger is lowered to its lowermost position prior to the time it passes the leading edge of the overlying ply. After the lower finger passes the leading edge of the overlying ply, it is elevated slightly from the surface of the table so that it is then inserted between the two plies as the pickup finger assembly is moved to its fully extended position where clamping and pickup occurs.

Once the pocket P is in position against stops 60, 62, two signals are sent to the pickup mechanism 100. A first signal indicates that it is time for the pickup mechanism to be activated, and the second signal indicates which type of pocket is positioned in the unloading position.

Figure 3A:
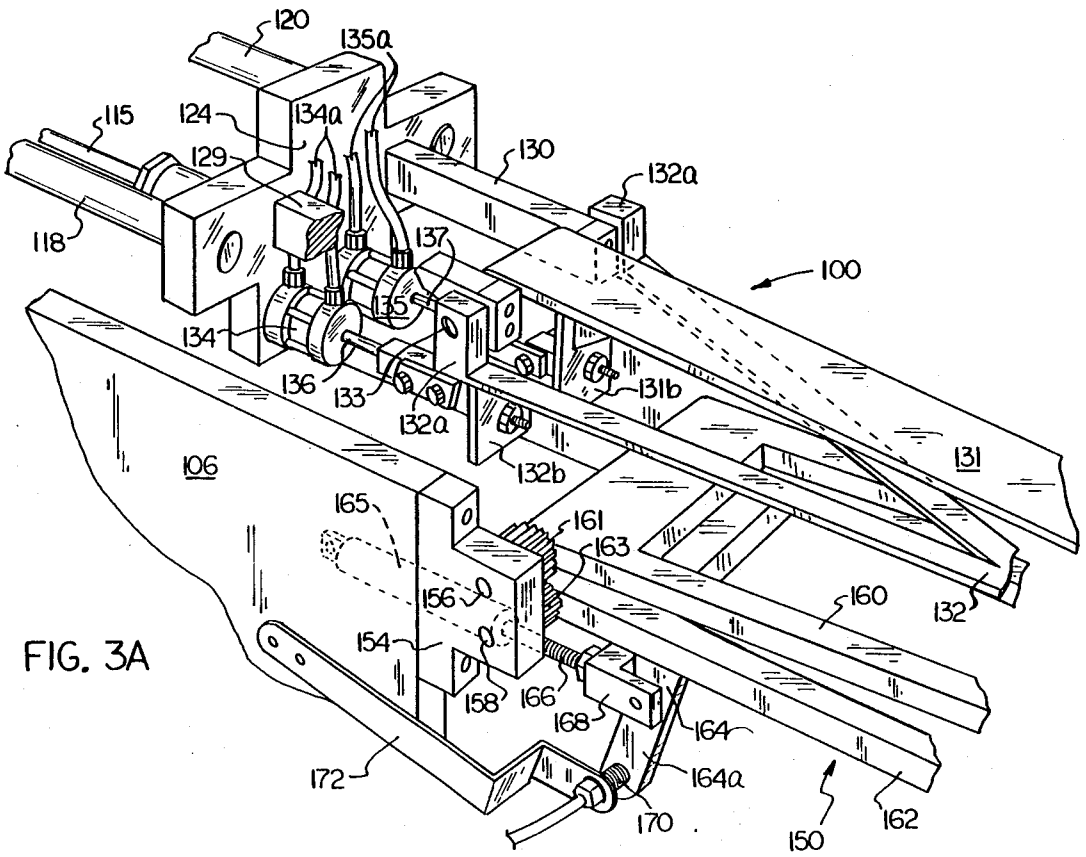

As best illustrated in FIGS. 2 through 3*a* there is illustrated the pocket pickup mechanism 100 which, in general, lifts and transfers the double-ply fabric work piece P from the surface 50 of the work table. The pickup means 100 generally includes a pair of vertically spaced, upper and lower clamping fingers 131, 132 and a linear actuator 114 for moving the clamping fingers 131, 132 from a retracted first position (FIG. 3) to an extended second position (FIG. 2). A pivotal means (hereinafter described) operatively manipulates fingers 131, 132 in timed sequence responsive to the signal from sensor 70.

More specifically, the pickup means 100 includes a base frame 102 upon which is mounted a rotary actuator 104. A support housing 106 is pivotally mounted to frame 102 about a vertical shaft 105 extending upwardly from the rotary actuator 104 and pivotally actuated thereby. So arranged the support housing 106 which carries both the pickup mechanism 100 and the spreading mechanism 150 may be rotated about a vertical axis to carry the spreading mechanism 150 between the loading station and a discharge station.

The pickup mechanism mounting plate 108 is secured atop the support housing 106 and includes a rearwardly extending support frame 109 attached thereto terminating in a support bracket 111. A pair of bearing blocks 110, 112 are mounted atop the mounting plate 108 and slidably connect the pickup mechanism 100 to the support housing 106 by means of guide rods 118, 120.

A tail piece 122 and a head wall 124 are connected between guide rods 118, 120 to form a generally rectangular, movable frame formed of the guide rods 118, 120, tail piece 122, and head wall 124. A linear actuator 114 is so arranged in parallel relation to guide rods 118, 120, centrally located therebetween, and supported by mounting plate 108 and support bracket 111. The free end of the piston 115 is connected to the head wall 124. So arranged, as the linear actuator 114 is operated the head frame 125 is moved between a retracted and extended position as illustrated in FIGS. 1–3. In the extended position, the pickup fingers 131, 132 are in position to pick up a fabric work piece.

A stop support bracket 116 extends upwardly above mounting plate 108. A first stop 126 is adjustably secured to the face of bracket 116 by means of a connecting rod 128 to provide a stop defining the rearward limit of the head wall 124. A second stop 127 is positioned on the rear side of stop bracket 116 to define the forward limit of the tail piece 122. For this purpose, of course, stop 126 is in the path of head wall 124 and stop 127 is in the path of tail piece 122.

As best shown in FIGS. 3, 3*a* pickup fingers 131, 132 are pivotally mounted to a pair of forwardly projecting mounting rods 129, 130 which are secured to and extend forwardly from the head wall 124. A pivot rod 133 extends through the forward ends of mounting rods 129, 130. Upper finger 131 is pivotally mounted to the pivot pin 133 at a point between mounting rods 129, 130 and lower pickup finger 132 includes a pair of upstanding lugs 132*a* which have appropriate openings therein for mounting thereof on pivot shaft 133 (see FIG. 3*a*). In order to activate the pickup fingers 131, 132 each pickup finger includes a downwardly extending activating flange 131*b*, 132*b*, respectively. A small linear actuator 134 is secured to the face of head wall 124 and includes a piston 136 thereof which is interconnected to the rear side of flange 132*b*. Similarly, a second linear actuator 135 includes the piston rod 137 thereof linked to the flange 131*b*. Air is provided to both ends of the linear actuator 134 through lines 134*a* and air is provided to both ends of linear actuator 135 through the lines 135*a*. So arranged, when the linear actuator 134 is activated to extend, the lower pickup finger 134 is caused to pivot upwardly. Conversely, when the actuator 134 is activated so as to retract, the lower finger 132 is caused to pivot downwardly. Similarly, when the linear actuator 135 is activated to the extended position, the upper finger 131 is caused to pivot upwardly and conversely when the linear actuator 135 retracts the upper finger 131 is pivoted downwardly.

As is best shown in FIG. 3 there are provided four proximity switches 141, 142, 143, and 144 which are strategically mounted on the pickup mechanism in order to control the movement of linear actuators 114, 134, and 135. The first or front proximity switch 141 indicates that the guide rods 118, 120 are fully retracted after picking up a fabric piece. Responsive thereto rotation of the spreading assembly 150 is initiated by activating the rotary actuator 104 as will be described hereinafter. When the second proximity switch 142 is armed by sensor 70 and activated by the passage of tail piece 122, the lower pickup finger 132 is lowered prior to passing the leading edge of the protruding ply (FIG. 2*d*) by retraction of actuator 134. Proximity switch 143 senses movement of the lower finger 132 past the leading edge of the protruding ply. When so armed by sensor 70 the lower finger 132 is not lowered until it has so passed the leading edge (FIG. 2*b*). Proxmity switch 144 is determinative of when the guide rods are fully extended and that the upper and lower fingers 131, 132 should clamp together (FIGS. 2*c*, 2*f*). Linear actuator 135 is then retracted from its normally extended position, so that the upper finger 131 lowers into clamping position. Also this indicates that the linear actuator 114 should be retracted. As previously described linear actuator 114 is activated to begin the extending operation responsive to photocell 68 which indicates the presence of a work piece P at the proper place on the surface 50 of the work table.

Spreading Jaw Mechanism

As previously described, when the pickup mechanism 100 has deposited a work piece P on the spreading mechanism 150, the spreading mechanism is ready to move the loaded work piece P into a discharge position for the inverting operation. Toward this end, in general, the spreading mechanism 150 includes a pair of pivotally operated, upper and lower jaws 160, 162 respectively upon which the work piece is mounted, and a rotating mechanism for rotating the spreading mechanism around a vertical axis to the discharge position illustrated in FIG. 4. The rotating operation is carried out by the rotary actuator 104 previously described which is connected to the support housing 106 by means of the vertically oriented rotary shaft 105.

In order to mount the spreading jaws 160, 162 there is provided a pair of side brackets 152, 154 which extend forwardly from the ends of the opposed side walls of support housing 106. Upper and lower pivot pins 156, 158 respectively, extend between the brackets 152, 154 as illustrated in FIGS. 3*a* and 4. The rear end of each of jaws 160, 162 include transverse passageways (not shown) through which the pivot pins 156, 158 extend. A small gear or pinion 161 is attached to one or both sides of the rear end of upper jaw 160 and similarly a small gear or pinion 163 is secured to one or both sides of the lower jaw 162. Gears 161 and 163 mesh together to provide a resulting cooperating pivotal movement. A small ear or dog 164 extends downwardly from lower jaw 162. An air cylinder 165 having the cylinder portion thereof secured to the inner surface of wall 106 is provided with a piston 166 extending therefrom parallel and beneath the lower jaw 162. The yoke 168 is attached to the free end of piston 166 which in turn is pivotally attached to the aforesaid depending bracket or lug 164. So arranged, as the air cylinder 165 is actuated, the lower jaw 162 is caused to pivot in a vertical arcuate path. Simultaneously, the upper jaw 160 is also caused to pivot in a vertical arcuate path because of the meshing of gears 161 and 163. Thus, when the piston 166 is retracted, jaws 160 and 162 are spread. On the other hand when piston 166 is extended jaws 160, 162 are closed into relatively close juxtaposed positions.

As illustrated in FIG. 3*a* an ear extension 164*a* depends from ear 164. A proximity switch 170 is supported by a bracket arm 172 in the path of extension 164*a*. Should the jaws 160, 162 open sufficiently for proximity switch 170 to be tripped by extension 164*a*, an electrical signal results indicative of excessive jaw spread, which would be occasioned by the lack of a work piece on jaws 160, 162. This would indicate a fault and reset the entire electrical system back to pick up a new work piece.

Looking now at FIG. 3, a seam locating lever 180 is pivotally attached to the side of housing 106 by a pivot pin 186. A locater blade 182 is attached to and extends from lever 180 and is normally held thereby between jaws 160, 162. An air cylinder 184 activates lever 180 between the retracted position (FIG. 3) and the spread position (FIG. 4). In the spread position the blade 182 engages the seam of work piece P and ensures that the seam lies contiguously along the edge thereof preventing slippage upwardly or downwardly from the desired edge position.

Figure 4A:
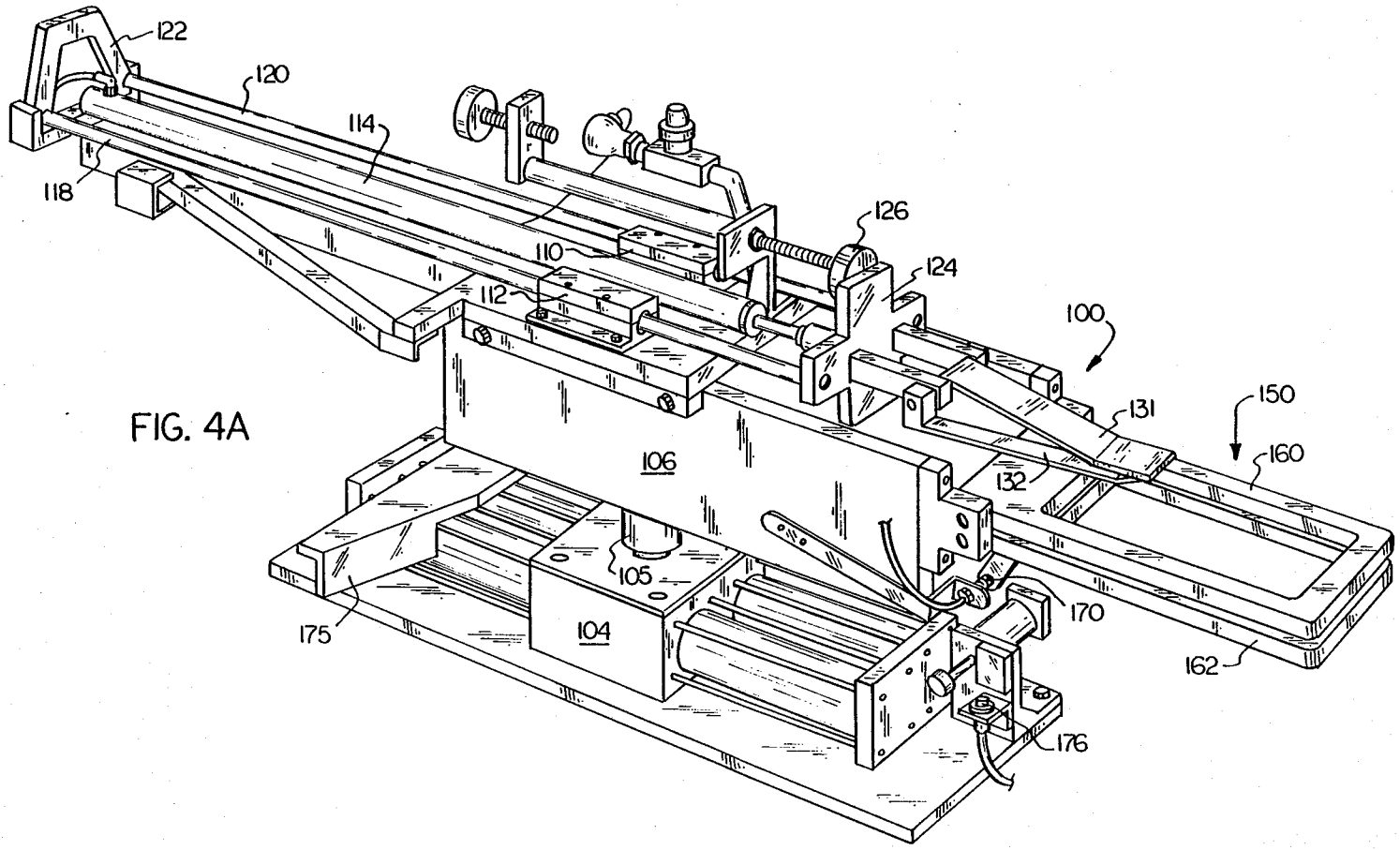

As stated hereinabove, the activation of the rotary actuator 104 is initiated by proximity switch 141 which indicates that the pickup mechanism 100 is fully retracted. As the turning jaw assembly 150 begins to rotate, a bracket 175 (FIG. 4*a*) which may either depend from or actually be a portion of a side wall of housing 106 is separated from a proximity switch 176 which in turn signals the air cylinder 165 to retract, thereby spreading jaws 160, 162. As rotation is completed a second bracket 177 approaches and activates proximity switch 178 signalling that the rotation is complete, whereupon the fingers 131, 132 are released preparing the work piece for transfer to the inverter mechanism 200.

Inverter Assembly

Turning now to FIGS. 5–10, there is illustrated the inverter assembly 200 according to the present invention at various points during the operating sequence. For example, in FIG. 5 the inverter assembly 200 is in its "ready" position prior to the time any movement is initiated. In FIG. 6, the inverter assembly has been activated to move the split mandrel means 222, 224 forwardly into position between the jaws of the spreader mechanism 150 inverting the work piece P. In FIG. 7, the plates of the split mandrel are spread, and in FIG. 8 the mandrel assembly 222, 224 has been retracted to remove the pocket member P from the turning jaw assembly. In FIG. 9 the inverter assembly 200 has been rotated 180° in preparation for extending the mandrel assembly through the smoothing device 300. In FIG. 10 the work piece has been moved through the pressing device 300 and is in position for removal from the mandrel assembly for the final seaming operation.

Looking now at the specific structural arrangement of the preferred embodiment, there is illustrated a rotary actuator 202 similar to that described with respect to rotary actuator 104 and having a rotating shaft 204 which supports an inverter support table 206. A pair of end walls 208, 210 extend upwardly from opposite ends of table 206 and support therebetween a pair of parallel, spaced apart guide rods 212, 214. A mounting plate 216 is slidably supported on guide rods 212, 214 by a plurality of slide bearings 218 secured to the underside of plate 216 for movement axially of the guide rods 212, 214. A linear actuator 220 has the cylinder base mounted on end wall 208 and the other end thereof is connected to plate 216 for movement thereof along guide rods 212, 214 in accordance with the operating sequence to be described hereinafter. Stop support brackets 209, 211 are secured to and extend upwardly from end walls 208, 210 respectively and have attached thereto end stops 219, 218 respectively for defining and limiting the maximum extent of the path of movement of plate 216.

A mounting bracket 220 is secured to the upper surface of plate 216 for carrying the mandrels 222, 224. A first stationary mandrel member 222 has the proximal end 223 thereof secured to plate 216. The pivotal mandrel member 224 extends outwardly from a lever arm 226. The lever arm 226, in turn, includes a first laterally extending leg 230 that is pivotally attached at the end thereof to the mounting bracket 220. A second laterally extending leg 228 extends in the opposite direction for movement between the stop member 236 and a position beneath proximity switch 238. An air cylinder 232 has the base end of the cylinder thereof secured to the mounting bracket 220 as illustrated in FIG. 5 and the piston thereof includes a clevis 234 which is attached to the arm 230. So arranged, actuation of the cylinder 232 causes the piston thereof to move between the retracted positions illustrated in FIGS. 5 and 6 and the extended position illustrated in FIGS. 7–10. In the retracted position the pivotal moving mandrel member 224 is arcuately retracted to a position atop the stationary mandrel member 222. When the cylinder 232 is extended the mandrel member 224 is spread outwardly to the position shown in FIGS. 7–10 which stretches and secures the work piece thereon during the inverting step as illustrated in FIG. 7.

A pair of arcuately activated stop members 240 are pivotally attached to mounting blocks 242 at a position beneath the movement of table 216. Cooperating air cylinders 244 are coupled to the arcuately movable stops 240 to move them between the upstanding position illustrated in FIGS. 5–8 and the retracted or withdrawn position illustrated in FIGS. 9 and 10. In the upstanding position the stop members 240 are in the path of table 216 thereby preventing the stroke of the mandrel members 222, 224 from extending too far into the space between the turning jaws 160, 162. When the table 206 is moved to the pressing position illustrated in FIGS. 9 and 10, however, the stops 240 are retracted so that the plate 216 is allowed to extend the full length of its stroke until it engages the stop member 219. Thus the stroke provided in FIGS. 5–8 is shorter than the stroke provided in FIGS. 9 and 10.

As illustrated in FIG. 5 the inverter assembly 200 is at the initial loading position (indicated by proximity switch 250). It is at this point that the description of the sequence begins. In the position shown in FIG. 5, the stop brackets 240 are in the up position. The linear actuator 220 is first activated to move the plate 216 and the mandrel assembly 222, 224 to the extended position illustrated in FIG. 6. As soon as plate 216 leaves the retracted position as indicated by proximity switch 250, after a preset time delay, the cylinder 232 is activated to open mandrel member 224. Simultaneously the turning jaws 160, 162 begin to close. As the plate 216 extends to the intermediate position defined by the elevated stops 240 the forward edge of the plate 216 engages the stops and proximity switch 252 indicates the arrival of table 216. At this time the pocket member has been fully transferred to and is stretched onto the spread mandrel members 222, 224. The opposed jaws 160, 162 of the turning jaw assembly 150 have been returned to the closed position. When proximity switch 238 indicates that the arm 228 of lever 226 is in the fully extended position, and proximity switch 252 indicates that plate 216 has arrived in the intermediate position the spreader assembly 150 begins to return to its load position; simultaneously the linear actuator 220 is reversed and plate 216 is returned to its load position; and the rotary actuator 202 is activated to begin the rotation of the inverter assembly 200. Air cylinders 244 are retracted to lower stops 240.

As the rotation of inverter assembly 200 is completed a proximity switch 256 adjacent stop member 258 on the wall of rotator assembly 202 is activated. When a photocell 351 indicates the presence of a pocket on the mandrel assembly 222, 224 and when another photocell 352 at the second sewing station indicates that the station is clear, the linear actuator 220 is activated to once again move plate 216 forwardly. The spread mandrels 222, 224 push the pocket member through the pressing or brush assembly 300 (to be hereinafter described) to a prescribed position defined by stop 219 and electrically indicated by switch 254. When the aforesaid photocell 352 indicates the presence of the pocket, a clamp 320 at the sewing station is activated. When the pocket is clamped by the aforesaid clamp a limit switch 354 reactivates the linear actuator 220 to return the support plate 216 to its home or loading position. After the linear actuator 220 has retracted as again indicated by proximity switch 250, the mandrel plate 224 collapses and rotation back to the home position occurs.

Wrinkle Pressing Assembly

Turning now to FIGS. 9 and 10 there is illustrated the wrinkle pressing assembly 300 which is generally positioned at the opposite end of the inverter mechanism 200 from the turning jaw mechanism 150. The wrinkle pressing assembly 300 includes a housing 302 having a bottom wall and a pair of spaced side walls with an opening through the front and rear thereof. A motor 304 is operatively positioned adjacent one of the side walls thereof and operatively connected to a plurality of drive sprockets 306 by means of chain 308.

When operated, the sprockets 306 which are connected to a plurality of presser rolls 310 cause rolls 310 to rotate in cooperating relationship. The upper pair of rolls 310 rotate clockwise as viewed in FIG. 9 and the lower pair of rolls 310 operate counterclockwise. The rolls 310 themselves are covered with a bristle material comprising nylon bristles with a diameter of approximately 0.010 inches.

As the fabric work piece passes between the upper and lower roller 310 the wrinkles are pressed out and the work piece exits the assembly 300 as if it had been ironed.

After the fabric work piece has been inserted through the wrinkle pressing assembly 300, it is deposited on the surface 350 of a work table where it is clamped in position by a tip clamp 320. Upon clamping by the tip clamp 320 the linear actuator 220 is reversed to withdraw the mandrel assembly 222, 224 as previously described. The fabric work piece is then moved by a flat plate 322 between a first position beneath the tip clamp 320 and a second position adjacent the sewing machine 324 much in the same manner as is carried out by plate 16 at sewing instrumentality S1. Again, the clamping and displacing of the fabric work piece is operated as described in the Carson et al U.S. Pat. No. 3,789,781 to apply the second seam around the periphery of the fabric blank.

In order to control the sequencing and operation of the inverter assembly 200 and the wrinkle presser assembly 300 a plurality of proximity switches and photocells are utilized. Proximity switch 250 is mounted on the table surface 216 beneath the retracted position of plate 216 to indicate when plate 216 is returned to the home position and wnen it has left. Likewise proximity switches 254 and 252 are placed at the opposite and at an intermediate position respectively to indicate when the plate 216 has been fully extended (for pressing), and partially extended (for inverting and picking up the fabric work piece). Proximity switch 256 is positioned adjacent a stop member 258 in the path of a depending lug 260 from table 206 to indicate when the inverter assembly has been rotated to the position for introducing the fabric work piece through the presser mechanism. Likewise, the proximity switch 262 positioned adjacent a second stop member 259 senses the presence of the depending bracket 260 when the inverter assembly 200 has been returned to the "home" position in preparation for picking up a new fabric work piece from the turner jaw mechanism 150.

A photocell 351 is positioned atop the entrance to housing 302 to indicate that a fabric work piece is present and about to be pushed through the roller assembly 310. Should photodetector 351 not detect the presence of a fabric work piece on mandrel assembly 222, 224, an electrical signal results indicative of a fault and resets the electrical system back to invert a new work piece. Photocell 352 indicates the presence of a fabric work piece at the proper position on table 350 and activates the tip clamp 320. As the tip 320 is lifted responsive to the placement of pad 322 thereon, a mechanical switch 354 is activated to operate the sewing mechanism.

While a preferred embodiment of the invention has been described in detail hereinabove, it is obviously apparent that various changes and modifications might be made without departing from the scope of the invention. For example, the turning jaw mechanism 150 is illustrated as being rotatable throughout an angle of approximately 120°. It is possible that with a relocation of the inverter mechanism 200 that angle might be appreciably reduced. Further, it is contemplated that the inverter mechanism 200 might not rotate 180° prior to the introduction of the fabric work piece to the wrinkle pressing assembly 300. Rather, the inverter mechanism 200 might be extended to an intermediate position where the fabric work piece is inverted and picked up, then rotated less than 180° or not rotated at all and pushed to an extended position through a wrinkle presser mechanism. Thus, the scope of the invention should be determined by the following set of claims.

What is claimed is:

1. Apparatus for automatically and sequentially sewing preformed, pocket-like, multi-ply fabric work pieces into garment components which are double seamed along a portion of at least some, but not all, sides comprising:

(a) spaced sewing instrumentalities, one of said sewing instrumentalities applying a first seam to the work piece when positioned inside out with the margins outturned, the second of said sewing instrumentalities applying a second seam to the work piece when positioned rightside out with the margins inturned;

(b) first transfer means for moving singly seamed, inside out work pieces from a position beneath the first sewing instrumentality to an adjacent station subsequent to the application of said first seam;

(c) pickup finger means for grasping the uppermost ply of said work piece adjacent an unsewn edge thereof and removing said work piece from said loading station thereby causing the plies to separate;

a spreading jaw mechanism having a first loading position in the path of said work piece as it is removed from said loading station by said pickup means, said spreading jaw mechanism including a pair of vertically spaced, horizontally extending jaws insertable between the plies of said work piece and means for moving said jaw from a first closed receiving position to a second open holding position;

(e) first rotational means for turning said spreading jaw mechanism in a horizontal plane from said first loading position to a second inverting position;

(f) expandable mandrel means insertable between the jaws of said spreading jaw mechanism when in the open holding position at said second inverting position, said expandable mandrel means comprises a support table carrying a mounting bracket, said mounting bracket supporting a pair of substantially horizontally planar, juxtaposed plates, one of said plates at least partially overlying the other; mandrel shifting means connecting said support table and said mounting bracket for moving said mandrel means in a horizontal path into position between said jaws to engage and invert said work piece; and mandrel control means for expanding at least one of said plates laterally from a collapsed position to an expanded position to spread said work piece, said jaws being returned to said closed receiving position simultaneously with the expanding of said mandrel means;

(g) means for moving said mandrel means, while expanded with the inverted work piece thereon to a position adjacent said second sewing instrumentality;

(h) transfer means for removing said work piece from said mandrel and positioning said work piece beneath said second sewing instrumentality in preparation for applying the second seam; and (i) control means to operate said mechanisms in timed relation with each other.

2. The apparatus according to claim 1 wherein said pickup finger means comprises:

(a) identifying means for determining whether the upper ply of said work piece extends outwardly beyond the lower ply or vice versa and for transmitting an electrical signal representative thereof;

(b) a transfer means including a pair of vertically spaced, upper and lower clamping fingers carried by a linear actuator for moving said clamping fingers from a retracted first position to an extended second position at said loading station, and pivotal means for moving said fingers between a clamping position, an open position, and a first and second insertion position;

(c) control means responsive to said identifying means for receiving said electrical signal and operatively inserting said lower clamping finger during movement of said transfer means from said retracted position to said extended position, in either a first insertion path which corresponds to a receding upper ply edge or a second insertion path corresponding to a protruding upper ply edge.

3. The apparatus according to claim 2 wherein said loading station comprises a vertically actuable clamping member mounted above said work table for movement between a release position and a clamping position in engagement with said work piece for maintaining said work piece at a prescribed location on said work table with the unseamed edges of said work piece facing an adjacent side of said work table.

4. The apparatus according to claim 2 wherein said identifying means comprises a color sensing device mounted on said work table overlying said loading station, said color sensing device having means associated therewith for transmitting one of two types of electrical signals therefrom dependent on whether said sensing device senses a relatively dark color or a relatively light color.

5. The apparatus according to claim 2 wherein said transfer means comprises:

(a) a support base;

(b) a pair of horizontally spaced bearings mounted on said support base and slidingly receiving a pair of guide rods;

(c) a tail stock connecting the rear end of said guide rods and a support bracket connecting the front end of said guide rods;

(d) a finger support shaft mounted on and extending transversely across the front of said support bracket;

(e) upper and lower pickup fingers pivotally mounted on said support shaft, each of said pickup fingers including an abutment extending transversely to the longitudinal axis of said fingers;

(f) first and second relatively short stroke linear actuators mounted on said support bracket the free end of the piston of each linear actuator being in operative engagement with the abutment of a corresponding one of said fingers, whereby movement of said first and second linear actuator causes a pivotal movement of said pickup fingers;

(g) a third, relatively large stroke linear actuator secured to said support base between said guide rods and extending parallel with said guide rods, the free end of the piston of said third linear actuator being in operative engagement with the rear side of said support bracket for longitudinal movement thereof, the longitudinal axis of said third linear actuator being aligned with the longitudinal axis of said work piece as it is positioned at said work station.

6. The apparatus according to claim 5 wherein said control means comprises a plurality of proximity switches mounted on said support base for sensing movement of said transfer means, a first one of said proximity switches being in the path of and activated responsive to the complete extension of said third linear actuator; a second and third ones of said proximity switches being activated responsive to a signal from said identifying means as to when the lower finger should be lowered to its lowermost position and when the lower finger should be shifted to its intermediate position.

7. The apparatus according to claim 1 wherein said spreading jaw mechanism comprises a support base and a pair of spaced brackets mounted thereon, a pair of vertically spaced, horizontally extending jaws pivotally mounted between said brackets, and means for moving said jaws from a first closed position to a second open position responsive to the placement of a fabric work piece thereon.

8. The apparatus according to claim 7 wherein said spreading jaw mechanism further comprises a seam locating lever pivotally attached to the side of said support base, a locater blade attached to and extending from said lever and normally held in a first position between said jaws, means for activating said lever to move said locater blade from its normal first position between said jaws to a spread position engaging the seam of an inside out work piece and ensuring that said seam lies contiguously along the edge of said blade preventing slippage upwardly or downwardly from the desired edge position.

9. The apparatus according to claim 1 wherein said mandrel control means includes a mounting bracket having the proximal end of one of said plate members secured thereto, a lever pivotally attached to said mounting bracket and having the proximal end of the second of said plates attached thereto, a linear actuator connected to said lever for moving said second plate between a closed position and a spread position stretching and securing the pocket member thereon when said lever is activated to said spread position.

10. The apparatus according to claim 9 wherein said mandrel shifting means comprises a linear actuator mounted on said support table, the free end of the piston of said linear actuator being operatively connected with said mounting bracket, said linear actuator being operable to remove said mounting bracket between a first retracted position, a second intermediate position, and a third fully extended position; a pivotal stop means and means for moving said pivotal stop means between a lowermost position out of the path of movement of said mounting bracket and an elevated position in the path of said mounting bracket for defining the extent of said mounting bracket at said intermediate position.

11. The apparatus according to claim 1 and further including a wrinkle pressing assembly positioned intermediate said mandrel means and said second sewing instrumentality, said wrinkle pressing assembly being so positioned that said mandrel means passes therethrough in its path to said second sewing instrumentality.

12. The apparatus according to claim 11 wherein said pressing means comprises a plurality of presser rolls covered with a bristle material between which rolls said mandrel passes.

* * * * *